US009153405B2

(12) United States Patent
Sato

(10) Patent No.: US 9,153,405 B2
(45) Date of Patent: Oct. 6, 2015

(54) ION SOURCE DEVICE AND ION BEAM GENERATING METHOD

(71) Applicant: SEN Corporation, Shinagawa-ku, Tokyo (JP)

(72) Inventor: Masateru Sato, Tokyo (JP)

(73) Assignee: SEN CORPORATION, Tokyo (JP)

( * ) Notice: Subject to any disclaimer, the term of this patent is extended or adjusted under 35 U.S.C. 154(b) by 292 days.

(21) Appl. No.: 13/829,573

(22) Filed: Mar. 14, 2013

(65) Prior Publication Data

US 2013/0249400 A1 Sep. 26, 2013

(30) Foreign Application Priority Data

Mar. 22, 2012 (JP) ..... 2012-064716

(51) Int. Cl.

| | |
|---|---|
| ***H01J 7/24*** | (2006.01) |
| ***H05B 31/26*** | (2006.01) |
| ***H01J 27/02*** | (2006.01) |
| ***H01J 27/14*** | (2006.01) |

(52) U.S. Cl.

CPC ..... *H01J 27/024* (2013.01); *H01J 27/146* (2013.01)

(58) Field of Classification Search

USPC ..... 315/111.01–111.91

See application file for complete search history.

(56) References Cited

U.S. PATENT DOCUMENTS

| | | | | |
|---|---|---|---|---|
| 5,675,606 | A | 10/1997 | Brainard et al. | |
| 5,914,494 | A * | 6/1999 | Abbott | 250/492.21 |
| 6,239,440 | B1 * | 5/2001 | Abbott | 250/423 R |
| 6,583,544 | B1 * | 6/2003 | Horsky et al. | 313/359.1 |
| 6,768,121 | B2 | 7/2004 | Horsky et al. | |
| 7,999,479 | B2 * | 8/2011 | Biloiu et al. | 315/111.51 |
| 8,142,607 | B2 * | 3/2012 | Biloiu et al. | 156/345.39 |
| 2004/0000651 | A1 | 1/2004 | Horsky et al. | |
| 2004/0104682 | A1 * | 6/2004 | Horsky et al. | 315/111.81 |
| 2006/0097645 | A1 * | 5/2006 | Horsky | 315/111.81 |
| 2013/0249400 | A1 * | 9/2013 | Sato | 315/111.81 |

FOREIGN PATENT DOCUMENTS

| | | | |
|---|---|---|---|
| JP | S60240039 | A | 11/1985 |
| JP | H025331 | A | 1/1990 |
| JP | H08106872 | A | 4/1996 |
| JP | H0935648 | A | 2/1997 |
| JP | 2002-117780 | A | 4/2002 |
| JP | 2003249177 | A | 9/2003 |
| JP | 2007220550 | A | 8/2007 |
| JP | 2009205845 | A | 9/2009 |

OTHER PUBLICATIONS

Japanese Office Action mailed on Mar. 4, 2015 in the corresponding Japanese Patent Application No. 2012-064716, 10 pages.

* cited by examiner

*Primary Examiner* — Brandon S Cole
(74) *Attorney, Agent, or Firm* — Arent Fox LLP

(57) ABSTRACT

An ion source device has a configuration in which a cathode is provided in an arc chamber having a space for plasma formation, and a repeller is disposed to face a thermal electron discharge face of the cathode by interposing the space for plasma formation therebetween. An external magnetic field that is induced by a source magnetic field unit is applied to the space for plasma formation in a direction parallel to an axis that connects the cathode and the repeller. An opening is provided in a place corresponding to a portion in the repeller with the highest density of plasma that is formed in the space for plasma formation, and an ion beam is extracted from the opening.

11 Claims, 3 Drawing Sheets

ION SOURCE DEVICE AND ION BEAM GENERATING METHOD

This application is based upon and claims the benefit of priority from Japanese Patent Application No. 2012-64716, filed on Mar. 22, 2012, the disclosure of which is incorporated herein in its entirety by reference.

BACKGROUND OF THE INVENTION

1. Field of the Invention

The present invention relates to an ion source device, and more particularly, to an ion source device suitable for an ion implantation apparatus and an ion beam generating method.

2. Description of Related Art

An ion source device for an ion implantation apparatus which includes an electron source and a repeller for reflecting electrons from the electron source is known (Japanese Unexamined Patent Application Publication No. 2002-117780).

Hereinafter, an example of an ion source device will be described with reference to FIGS. 3A and 3B.

In FIGS. 3A and 3B, the ion source device includes an arc chamber 20 having a space for plasma formation. The arc chamber 20 includes a front slit 20-1 in a wall of a front face thereof and an introduction unit 20-2 of a source gas in a wall of a lateral face thereof. In addition, in the ion source device, an electron source is installed at one of opposed locations of the arc chamber 20 with the space for plasma formation that is interposed therebetween, and a repeller 23 is installed at the other one thereof. The electron source includes a filament 21 and a cathode 22. As shown in FIG. 3B, in front of the front slit 20-1, a suppression electrode 24 and a ground (GND) electrode 25 which each have an opening through which an ion beam passes are disposed in parallel with each other in an extraction direction of the ion beam.

The ion source device is operated as follows. First, the filament 21 generates heat by a filament power source 26 so as to generate thermal electrons in a tip of the filament 21. The generated thermal electrons are accelerated by a cathode power source 27 so as to collide against the cathode 22, and the cathode 22 is heated by heat generated at the time of collision. The heated cathode 22 generates thermal electrons. The generated thermal electrons are accelerated by an arc voltage of an arc power source 28 that is applied between the cathode 22 and the arc chamber 20, and the generated thermal electrons are then discharged into the arc chamber 20 as beam electrons having energy sufficient to ionize gas molecules.

Meanwhile, in the arc chamber 20, a source gas is introduced from an introduction unit 20-2, and an external magnetic field F is applied. In addition, in the arc chamber 20, the repeller 23 is provided so as to face a thermal electron discharge face of the cathode 22. The repeller 23 has a function to reflect electrons. A direction of the external magnetic field F is parallel to an axis that connects the cathode 22 and the repeller 23. For this reason, the beam electrons that are discharged from the cathode 22 reciprocate between the cathode 22 and the repeller 23 along the external magnetic field F, and then collide against source gas molecules that are introduced into the arc chamber 20 so as to generate ions. As a result, plasma is generated in the arc chamber 20.

Since the beam electrons are present within a nearly-limited range by an applied magnetic field, ions are mainly generated within the range, and the ions arrive at an inner wall of the arc chamber 20, the front slit 20-1, the cathode 22, and the repeller 23 by diffusion and are lost in a wall surface.

On the other hand, an ion beam is extracted by passing through a slit that is parallel to a magnetic field from plasma that is diffused to the front slit 20-1. A current of the ion beam that is extracted (extraction current) depends greatly on plasma density in the front slit 20-1. For example, if the plasma density in the front slit 20-1 is high, an extractable beam current (extraction current) increases.

Incidentally, it is not likely that plasma diffusion in a direction at a right angle to the external magnetic field F occurs in the arc chamber 20, compared to plasma diffusion that is parallel to the external magnetic field F. Accordingly, plasma density rapidly decreases in the direction at a right angle to the external magnetic field F. In an ion source device of the related art, a beam extraction portion is placed at a location where plasma diffuses in the direction at a right angle to the external magnetic field F. In other words, the front slit 20-1 is provided in a wall of the arc chamber 20 in a direction perpendicular to a direction of the external magnetic field F. For this reason, the plasma density in the front slit 20-1 decreases, and thus the amount of ion beam that is extracted, that is, the extraction current, is also limited.

In the present situation, in order to increase a drawing beam, that is, in order to increase the plasma density in the front slit 20-1, a method of, for example, increasing a thermal electron current from the cathode 22 is adopted. As a matter of course, this causes a reduction in the life-span of the cathode 22 because the plasma density in the cathode 22 and the repeller 23 also increases.

In an ion source device such as an ion implantation apparatus, from the point of view of an increase in productivity, it is required to further increase an extraction current from the ion source device. In order to increase the extraction current, it is required to generate plasma with a higher density in the vicinity of an ion beam extraction portion (front slit) of the ion source device. Accordingly, it is required to supply high power to the ion source device.

SUMMARY OF INVENTION

The present invention aims to increase an extraction current by increasing plasma density near an ion beam extraction portion without supplying high power.

In one embodiment, there is provided an ion source device for ion beam generation, wherein a cathode that discharges thermal electrons for generating beam electrons that ionize neutral molecules is provided in an arc chamber having a space for plasma formation, and a repeller is disposed to face a thermal electron discharge face of the cathode by interposing the space for plasma formation therebetween, wherein an external magnetic field F that is induced by a source magnetic field unit is applied to the space for plasma formation in a direction parallel to an axis that connects the cathode and the repeller, and wherein an opening is provided in a place corresponding to a portion in the repeller with the highest density of plasma that is formed in the space for plasma formation, and an ion beam is extracted from the opening.

In the ion source device, an extraction direction of the ion beam may be parallel to the axis that connects the cathode and the repeller.

In the ion source device, the opening may be provided in a place facing an outlet opening of the ion beam of the arc chamber. The opening and the outlet opening of the ion beam may have a circular shape or any other shape.

In the ion source device, the opening may be a size that is the same as or smaller than that of the outlet opening of the ion beam and that does not decrease the density of the plasma that is formed in the space for plasma formation.

The ion source device may include a mechanism that allows the repeller to move in a direction of the axis that connects the cathode and the repeller and allows a gap between the outlet opening of the ion beam and the repeller to vary.

In the ion source device, the repeller may be in a floating state without applying a potential, or a negative constant potential or a negative variable potential may be applied to the repeller.

In the ion source device, the arc chamber may have a tubular shape, an electron source including the cathode may be installed at one end in a central axis direction of the arc chamber, the repeller may be installed at the other end thereof, and the source magnetic field unit may be disposed around the arc chamber so as to surround a tubular wall of the arc chamber.

In another embodiment, there is provided an ion beam generating method using an ion source device that has a configuration in which a cathode that discharges thermal electrons for generating beam electrons that ionize neutral molecules is provided in an arc chamber having a space for plasma formation, and a repeller is disposed to face a thermal electron discharge face of the cathode by interposing the space for plasma formation therebetween, the method including: applying an external magnetic field F that is induced by a source magnetic field unit to the space for plasma formation in a direction parallel to an axis that connects the cathode and the repeller; and extracting an ion beam from an opening that is provided in a place corresponding to a portion in the repeller with the highest density of plasma that is formed in the space for plasma formation.

In the ion source device of the present invention, it is possible to extract an ion beam from plasma with a high density of several tens of times of plasma density in a plasma extracting portion of the related art, thereby increasing a beam current.

On the other hand, when a beam current that is equivalent to the related art is obtained, there is an advantage in that power to be supplied and an amount of gas to be introduced may be low.

It is required to set a high voltage of an arc power source in order to increase multivalent ions, but in the related art, when intending to increase the plasma density of the cathode, the life-span of a cathode is reduced. However, in the present invention, rather than increasing the plasma density of a cathode, the ion beam is allowed to be extracted from plasma that is nearly equivalent to the plasma density of the cathode which is high enough compared to the plasma density of a plasma extracting portion of the related art, and thus the life-span of the cathode is extended compared to a case of increasing the plasma density of the cathode.

DETAILED DESCRIPTION OF THE INVENTION

Figure 1A:
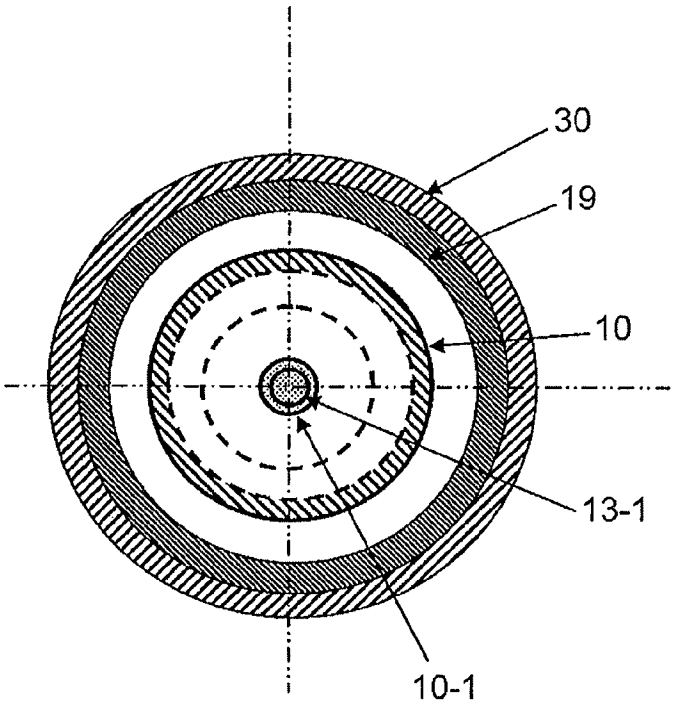
FIGS. 1A and 1B are respectively a front view and a cross-sectional side view for describing an ion source device according to the present invention.

Hereinafter, an embodiment of an ion source device according to the present invention will be described with reference to FIGS. 1A and 1B. FIG. 1A is a front view of the ion source device seen from an extraction portion of an ion beam, and shows a case where a suppression electrode 14-1 and a ground electrode 14-2 shown in FIG. 1B are excluded.

[Configuration]

Figure 1B:
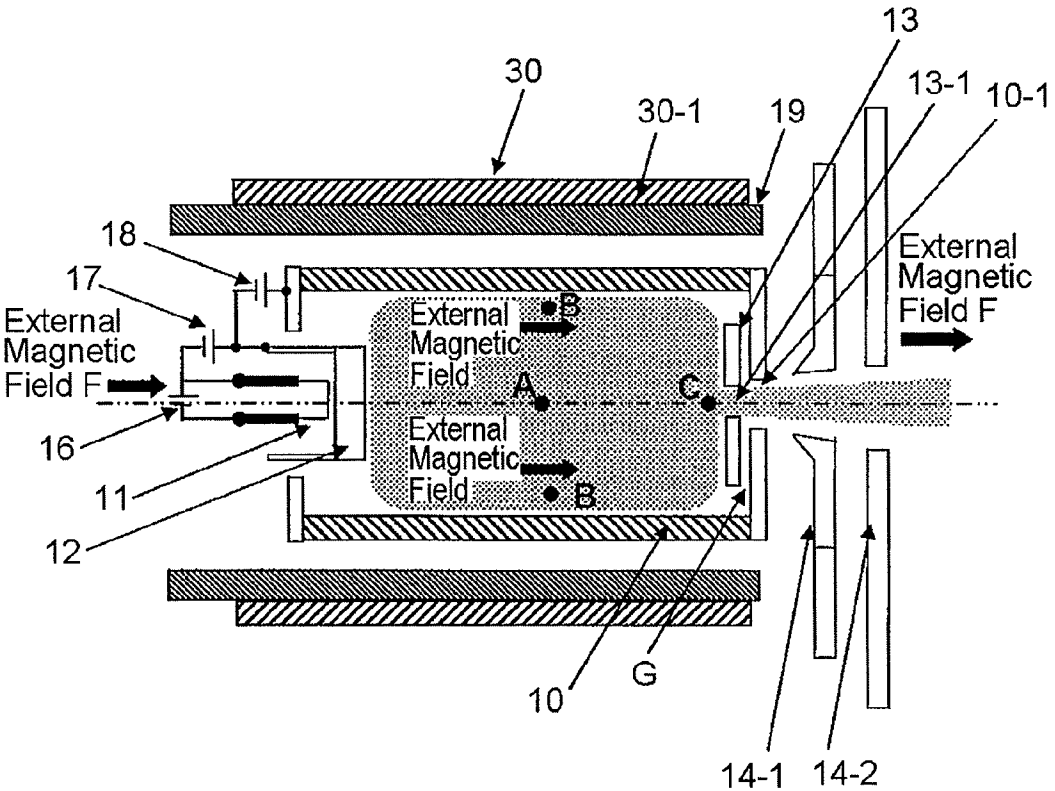

In FIGS. 1A and 1B, the ion source device includes an arc chamber 10 having a space for plasma formation. The arc chamber 10 is formed by transversely disposing a chamber having a tubular shape, in particular a cylindrical shape, and includes an electron source at one end (back face) thereof in a central axis direction. Similarly to the electron source described in FIGS. 3A and 3B, an electron source of the ion source device includes a filament 11 and a cathode 12. The cathode 12 discharges thermal electrons for generating beam electrons that ionize neutral molecules from a thermal electron discharge face thereof. A repeller 13 is installed inside the other end (front face) of the arc chamber 10 in the central axis direction so as to face the thermal electron discharge face of the cathode 12 by interposing the space for plasma formation therebetween. An outlet opening 10-1 of the ion beam is provided in the center of the other end of the arc chamber 10 in the central axis direction. In addition, a gas introduction unit (not shown) for introducing a source gas into the space for plasma formation is provided in the arc chamber 10.

Figure 3B:
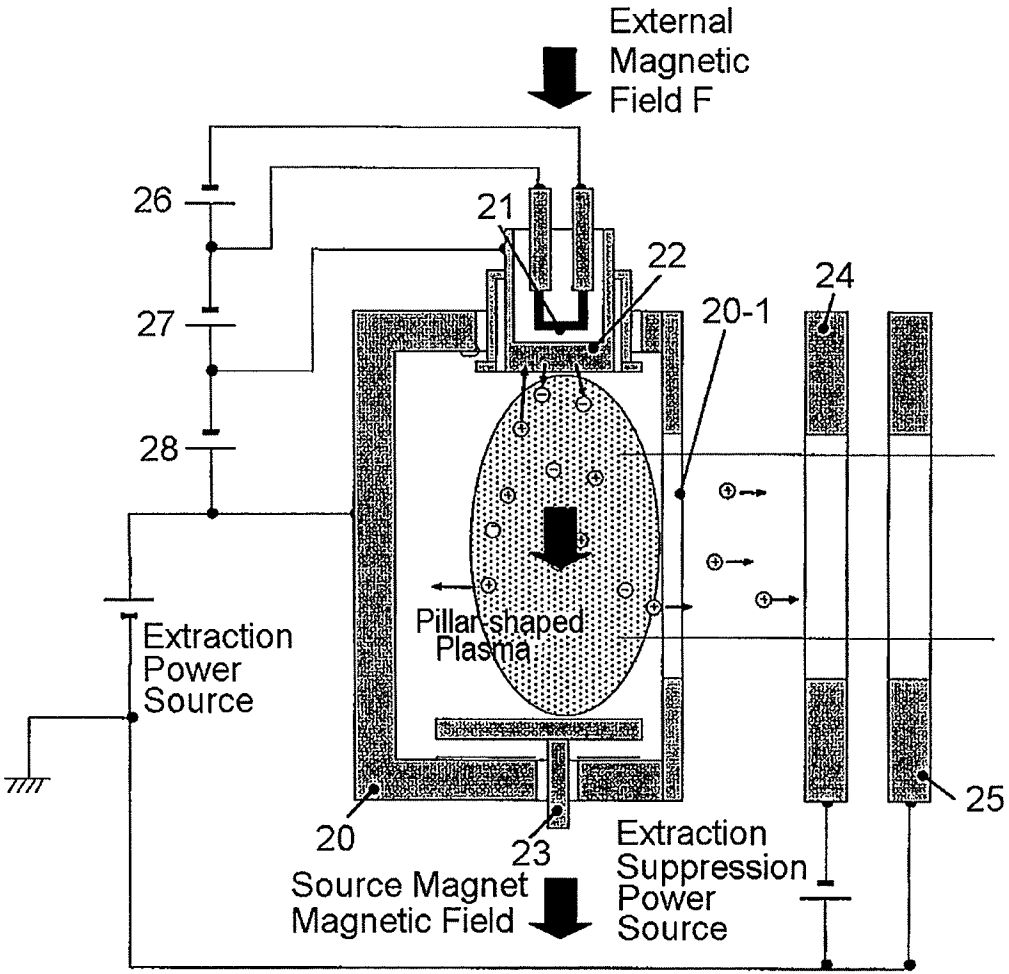
FIGS. 3A and 3B are respectively a cross-sectional front view and a cross-sectional side view for describing an ion source device of the related art.
Figure 3A:
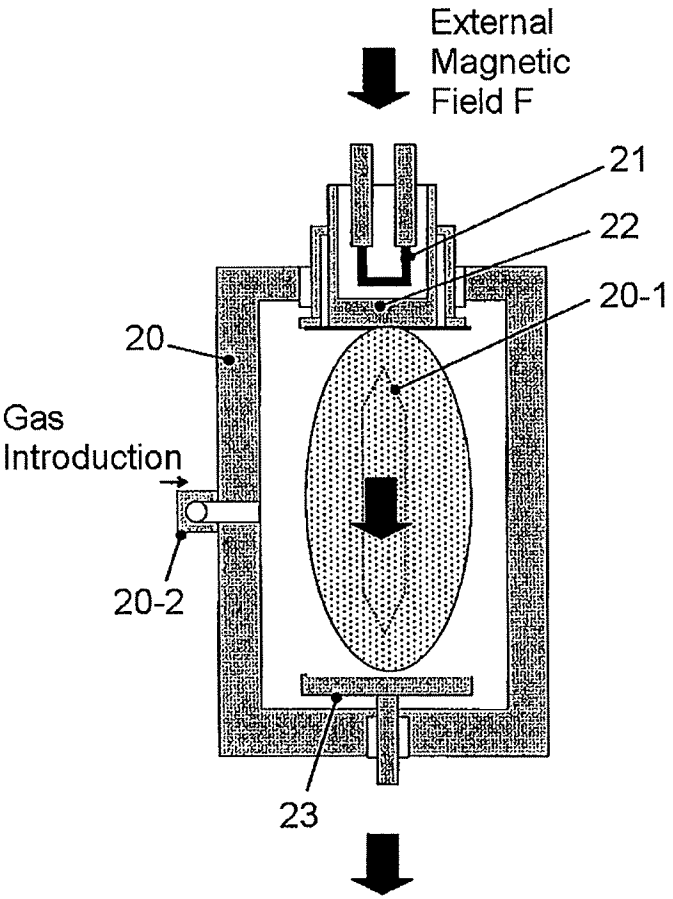

Similarly to the example described in FIGS. 3A and 3B, a filament power source 16 is connected to the filament 11, and a cathode power source 17 and an arc power source 18 are respectively connected between the filament 11 and the cathode 12 and between the arc chamber 10 and the cathode 12.

A source magnetic field unit 30 is disposed around the arc chamber 10 via a concentric heat shield 19 having a tubular shape so as to surround a tubular wall of the arc chamber 10. Here, the source magnetic field unit 30 is realized by a solenoid coil 30-1, and induces and applies an external magnetic field F to the space for plasma formation in a direction parallel to an axis that connects the cathode 12 and the repeller 13. The source magnetic field unit 30 can include a magnetic field caused by a permanent magnet device, in addition to a magnetic field caused by the solenoid coil 30-1.

As described in FIGS. 3A and 3B, at the other end of the arc chamber 10 in the central axis direction, the suppression electrode 14-1 and the GND (ground) electrode 14-2 are disposed at a location that is slightly distant outwards from the outlet opening 10-1 of the ion beam so as to be parallel to each other in an extraction direction of the ion beam.

In the above-mentioned configuration, in the embodiment, the repeller 13 is disposed such that a predetermined gap G is formed between the repeller 13 and the other end of the arc chamber 10 in the central axis direction. In the repeller 13, an opening 13-1 is provided in a place that faces the outlet opening 10-1 of the ion beam. As will be described later, the facing place is a place corresponding to a portion with the highest ion density of plasma that is formed in the space for plasma formation in the repeller 13 having a plate shape. As a result, the extraction direction of the ion beam becomes parallel to the axis that connects the cathode 12 and the repeller 13, and centers of the opening 13-1 and the outlet opening 10-1 are consistent with a central axis of the ion beam that is extracted from the opening 13-1 and the outlet opening 10-1.

Here, although both the opening 13-1 and the outlet opening 10-1 have a circular shape, the opening 13-1 and the outlet opening 10-1 can have any other shape. In addition, the opening 13-1 is formed to have a size that is the same as or smaller than that of the outlet opening 10-1 and that is set not to decrease the density of the plasma that is formed in the space for plasma formation.

Meanwhile, the repeller 13 can be in a so-called floating state without applying a potential, or, a negative constant potential or a negative variable potential having a magnitude sufficient to reflect beam electrons in a range of several tens of volts can be applied to the repeller.

As described above, in the ion source device according to the embodiment, similar to the related art, the cathode 12 that discharges thermal electrons for generating beam electrons that ionize neutral molecules is disposed in the arc chamber 10, and the repeller 13 is disposed to face the thermal electron discharge face of the cathode 12. In addition, the external magnetic field F that is induced by the solenoid coil 30-1 is applied in a direction parallel to the axis that connects the cathode 12 and the repeller 13.

Here, in the related art, regarding the extraction of an ion beam, a front slit is provided in a wall of a front face of an arc chamber in a direction perpendicular to a direction of an external magnetic field F to extract the ion beam.

To this, in the embodiment, the opening 13-1 is provided in a place of the repeller 13 which corresponds to a portion with the highest ion density of plasma that is formed in a space for plasma formation, and the ion beam is extracted via the outlet opening 10-1 from the opening 13-1. It can be also said that such an ion source device has a so-called axisymmetric structure.

[Functions]

Hereinafter, functions of the opening 13-1 will be described.

In general, the beam electrons emitted from the cathode 12 move along the external magnetic field F and are then recoiled at the repeller 13. The beam electrons ionize a neutral gas that is introduced from the gas introduction unit while the beam electrons are reciprocating between the cathode 12 and the repeller 13. Generated ions diffuse to an inner wall of the arc chamber around one.

For this reason, the plasma density is highest on the axis that connects the cathode 12 and the repeller 13 at a point A (see FIG. 1A) that is a center of the space for plasma formation, and the plasma density rapidly decreases at a point B (in the vicinity of the tubular wall of the arc chamber 10) at which the plasma diffuses across the external magnetic field F.

On the other hand, at a point C that is close to the repeller 13 and is on the axis that connects the cathode 12 and the repeller 13, the plasma density is high because the plasma easily diffuses due to diffusion in a direction along the external magnetic field F, that is, a so-called bipolar diffusion. This also applies even in a place that is close to the cathode 12. In a plasma density calculation under certain conditions, the point B is about 1/100 of the point A, while the point C is about ½ of the point A. Therefore, in the embodiment, the plasma density of the point C that extracts the ion beam is higher about 50 times than the plasma density of the point B corresponding to an ion beam extraction portion of the related art.

Meanwhile, when the opening 13-1 is provided in the repeller 13, some of the beam electrons contributing to the ionization of neutral molecules are not recoiled at the repeller 13. However, since the beam electrons arrive at the extraction portion and are then recoiled by an extraction potential, the generation efficiency of plasma does not decrease.

In addition, the plasma density around the outlet opening of the ion beam can be adjusted by allowing a distance (gap G) between the repeller 13 and the outlet opening 10-1 of the ion beam to vary, and thus the ion beam with a better characteristic can be extracted.

Figure 2:
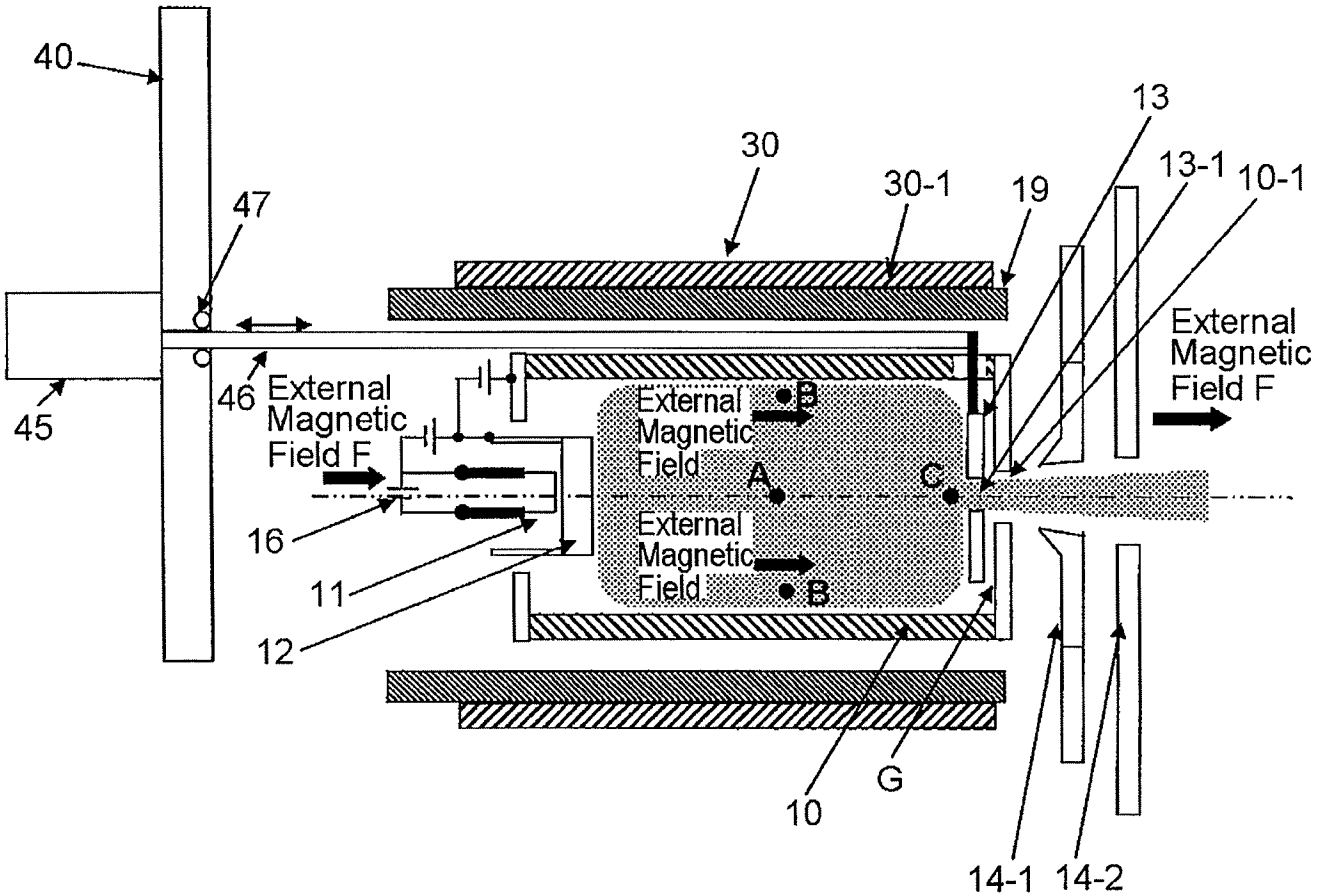
FIG. 2 is a cross-sectional side view for describing an example of a mechanism for allowing a position of a repeller to vary in the ion source device of FIGS. 1A and 1B.

FIG. 2 shows an example of a mechanism for allowing a position of the repeller 13 to change the size of the gap G between the repeller 13 and the outlet opening 10-1 of the ion beam. In FIG. 2, a repeller position adjustment device 45 is provided outside of a cover member 40 that is provided at one end (back face) of the ion source device. The repeller position adjustment device 45 penetrates the cover member 40 and includes a shaft member 46 that extends to the other end of the arc chamber 10 between the arc chamber 10 and the heat shield 19. The repeller position adjustment device 45 has a structure capable of manually or automatically displacing the shaft member 46 in an axial direction. A tip of the shaft member 46 has a hook shape so as to hold the repeller 13 via an opening provided in a side wall of the arc chamber 10, and allows the held repeller 13 to approach and separate with respect to the outlet opening 10-1 of the arc chamber 10. Reference numeral 47 denotes a vacuum seal. In addition, as in the ion source device of Japanese Unexamined Patent Application Publication No. 2002-117780, when both a repeller and a beam extraction hole are used, the beam extraction hole becomes a negative potential similar to the repeller, and the beam extraction hole is deformed due to severe sputtering in a short time, thereby creating problems in beam extraction. To this, according to the present invention, the repeller has a negative potential, while the beam extraction hole has the same potential as the plasma, and thus the beam extraction hole is not deformed, thereby extending the life-span of the beam extraction hole.

According to the above-mentioned embodiment, it is possible to extract an ion beam from plasma with a high density of several tens of times of plasma density in a plasma extraction portion of the related art, thereby increasing a beam current. On the other hand, when a beam current that is equivalent to the related art is obtained, power to be supplied and an amount of gas to be introduced can be low.

In the related art, if the plasma density of a cathode is increased in order to increase the plasma density of an extraction portion of an ion beam, the life-span of the cathode is reduced. However, in the above-mentioned embodiment, rather than increasing the plasma density of a cathode, the ion beam is allowed to be extracted from plasma that is nearly equivalent to the plasma density of the cathode which is high enough compared to the plasma density of a plasma extraction portion of the related art, and thus the life-span of the cathode is extended compared to a case of increasing the plasma density of the cathode.

As mentioned above, although the preferred embodiments of the present invention have been described herein, the present invention is not limited to these embodiments. The configuration and details of the present invention can be modified in various ways without departing from the scope and spirit of the present invention described in claims.

What is claimed is:

1. An ion source device for ion beam generation, wherein a cathode that discharges thermal electrons for generating beam electrons that ionize neutral molecules is provided in an arc chamber having a space for plasma formation, and a repeller is disposed to face a thermal electron discharge face of the cathode by interposing the space for plasma formation therebetween, wherein an external magnetic field F that is induced by a source magnetic field unit is applied to the space for plasma formation in a direction parallel to an axis that connects the cathode and the repeller, and wherein an opening is provided in a place corresponding to a portion in the repeller with the highest density of plasma that is formed in the space for plasma formation, and an ion beam is extracted from the opening.

2. The ion source device according to claim 1, wherein an extraction direction of the ion beam is parallel to the axis that connects the cathode and the repeller.

3. The ion source device according to claim 1, wherein the opening is provided in a place facing an outlet opening of the ion beam of the arc chamber, and the opening and the outlet opening of the ion beam have a circular shape.

4. The ion source device according to claim 3, wherein the opening has a size that is the same as or smaller than that of the outlet opening of the ion beam and that does not decrease the density of the plasma that is formed in the space for plasma formation.

5. The ion source device according to claim 3, comprising:

a mechanism that allows the repeller to move in a direction of the axis that connects the cathode and the repeller and allows the size of a gap between the outlet opening of the ion beam and the repeller to be changed.

6. The ion source device according to claim 1, wherein the repeller is in a floating state without applying a potential.

7. The ion source device according to claim 1, wherein a negative constant potential or a negative variable potential is applied to the repeller.

8. The ion source device according to claim 1, wherein the arc chamber has a tubular shape, an electron source including the cathode is installed at one end in a central axis direction of the arc chamber, the repeller is installed at the other end thereof, and the source magnetic field unit is disposed around the arc chamber so as to surround a tubular wall of the arc chamber.

9. An ion beam generating method using an ion source device that has a configuration in which a cathode that discharges thermal electrons for generating beam electrons that ionize neutral molecules is provided in an arc chamber having a space for plasma formation, and a repeller is disposed to face a thermal electron discharge face of the cathode by interposing the space for plasma formation therebetween, the method comprising:

applying an external magnetic field F that is induced by a source magnetic field unit to the space for plasma formation in a direction parallel to an axis that connects the cathode and the repeller; and extracting an ion beam from an opening that is provided in a place corresponding to a portion in the repeller with the highest density of plasma that is formed in the space for plasma formation.

10. The ion beam generating method according to claim 9, wherein an extraction direction of the ion beam is parallel to the axis that connects the cathode and the repeller.

11. The ion source device according to claim 1, wherein the arc chamber has a tubular shape, the cathode is installed at one end of the arc chamber in a central axis direction, an outlet opening of an ion beam is provided at another end of the arc chamber in the central axis direction, and the repeller is installed inside the other end of the arc chamber in the central axis direction.

* * * * *